US005320146A

United States Patent [19]

Stevie

[11] Patent Number: 5,320,146

[45] Date of Patent: Jun. 14, 1994

[54] VOLUMETRIC FEEDER WITH BELT GATE

[75] Inventor: John W. Stevie, Covington, Ky.

[73] Assignee: R. A. Jones & Co. Inc., Crescent Springs, Ky.

[21] Appl. No.: 8,530

[22] Filed: Jan. 26, 1993

[51] Int. Cl.[5] ..... B65B 43/42

[52] U.S. Cl. ..... 141/1; 141/144; 141/114; 141/166; 141/147; 141/181; 53/473; 222/367

[58] Field of Search ..... 141/1, 10, 114, 144, 141/147, 166, 181, 129; 53/384; 222/367

[56] References Cited

U.S. PATENT DOCUMENTS 3,453,799 8/1969 Cloud et al. .
3,478,492 11/1969 Cloud et al. .
3,505,776 4/1970 Cloud .
3,563,001 2/1971 Cloud et al. .
3,570,557 3/1971 Molins ..... 141/129 X
3,821,873 7/1974 Benner, Jr. et al. .
3,951,306 4/1976 Ernst ..... 222/367 X
4,232,504 11/1980 Dieterlen et al. .
4,316,566 2/1982 Arleth et al. .
4,344,269 8/1982 Dieterlen et al. .
4,702,289 10/1987 Benner et al. ..... 141/125
4,848,421 7/1989 Froese et al. ..... 141/114
4,865,092 9/1989 Reichelt ..... 141/129 X
4,884,599 12/1989 Newman et al. ..... 141/1
5,000,235 3/1991 Jourdan ..... 141/86

*Primary Examiner*—Ernest G. Cusick
*Attorney, Agent, or Firm*—Wood, Herron & Evans

[57] ABSTRACT

A feeder wheel has a top surface and a peripheral edge, with volumetric measuring cavities upon at one end to said top surface and at a lower end to said edge. An endless belt is entrained about a portion of the edge, covering cavity outlets open to said edge, but said belt is pulled away from said edge by a pulley at one side of the wheel. Product is dispensed from the cavities when their outlets are uncovered by the belt as the wheel turns. The cavities are filled by dropping product onto the top surface of the wheel and by gradually plowing the product over and into the cavities. The final plow is slightly curved over a number of cavities so the last product cut is gently performed to increase repeatable volumetric accuracy of product in each cavity. A method of feeding volumetric measured product includes dropping product onto the side of a wheel, sweeping the side to move product into volumetrically sized cavities in the wheel, turning the wheel and dispensing products radially from cavity outlets in the wheel edge when uncovered by a belt partially entrained about the wheel edge.

13 Claims, 6 Drawing Sheets

VOLUMETRIC FEEDER WITH BELT GATE

FIELD OF THE INVENTION

This invention relates to container or package filling and more particularly to apparatus and methods for metering volumetrically measured amounts of granular product into containers or packages such as pouches or cartons.

BACKGROUND

In the past, it has been known to feed product into open top pouches carried about a rotatable pouch filler wheel. Spouts carried on a spout plate extend down into open pouches and product flows through the spouts into aligned pouches. In one form of filler, the spout plate defines a plurality of funnels having bottom outlets opening into the depending spouts. Product on the spout plate is swept into these funnel-like openings when the funnels are rotated over aligned pouches on an underlying filler wheel. One form of such apparatus is described in U.S. Pat. No. 3,478,492.

In other forms of pouch filling, the spout plates are tilted with respect to the filler wheel to extend spouts into open-top pouches aligned therebeneath through a portion of the rotation of the spout filler wheel and underlying pouch filler wheel. Such apparatus is shown, for example, in U.S. Pat. Nos. 3,563,001; 3,821,873; 4,232,504; 4,344,269; 4,702,289 and 4,848,421.

It is now desirable, however, to provide pouch filling at varying speeds, and to higher accuracy. Such accuracy is hampered in these prior disclosures by the nature in which the funnels or other devices are filled and emptied. For example, while a plow has been used to sweep the upper surface in which the funnel tops are formed, turbulence and flow characteristics of products, as surface speeds increase, are a problem. These factors occur under the metering block and change the weights metered at different speeds.

Accordingly, it has been one objective of this invention to provide improved apparatus and methods for filling containers with product.

A further objective of this invention has been to provide improved volumetric measuring and pouch filling apparatus.

To these ends, a preferred embodiment of the invention includes a volumetric feeder wheel, an underlying spout wheel, and an underlying pouch filler wheel. The volumetric feeder wheel has a plurality of volumetric product measuring cavities having outlets disposed in a peripheral edge of the wheel. A belt is entrained about the wheel covering the outlets except in a sector where the belt is held away from the wheel by a pulley. This uncovers the outlets for discharge of the measured product in the cavities radially outwardly and downwardly into passages of the spout wheel, and at an angular sector where the spouts thereunder are aligned with open-top pouches on the filler wheel.

Once the belt re-engages the feeder wheel, and closes the cavity outlets, product is dispersed onto the feeder wheels' surface and is directed over the cavities to fill them, even when the outlets are not aligned with underlying pouches. This permits the use of a large sector of rotation for progressively and gently metering product on the feeder wheel surface into the cavities. Product turbulence on the upper surface of the feeder wheel is reduced and repeatably accurate pouch filling is provided even for very low volume pouch fills.

These and other advantages will become more readily apparent from the following written description of a preferred embodiment of the invention and from the drawings in which.

SPECIFICATION

Figure 1:
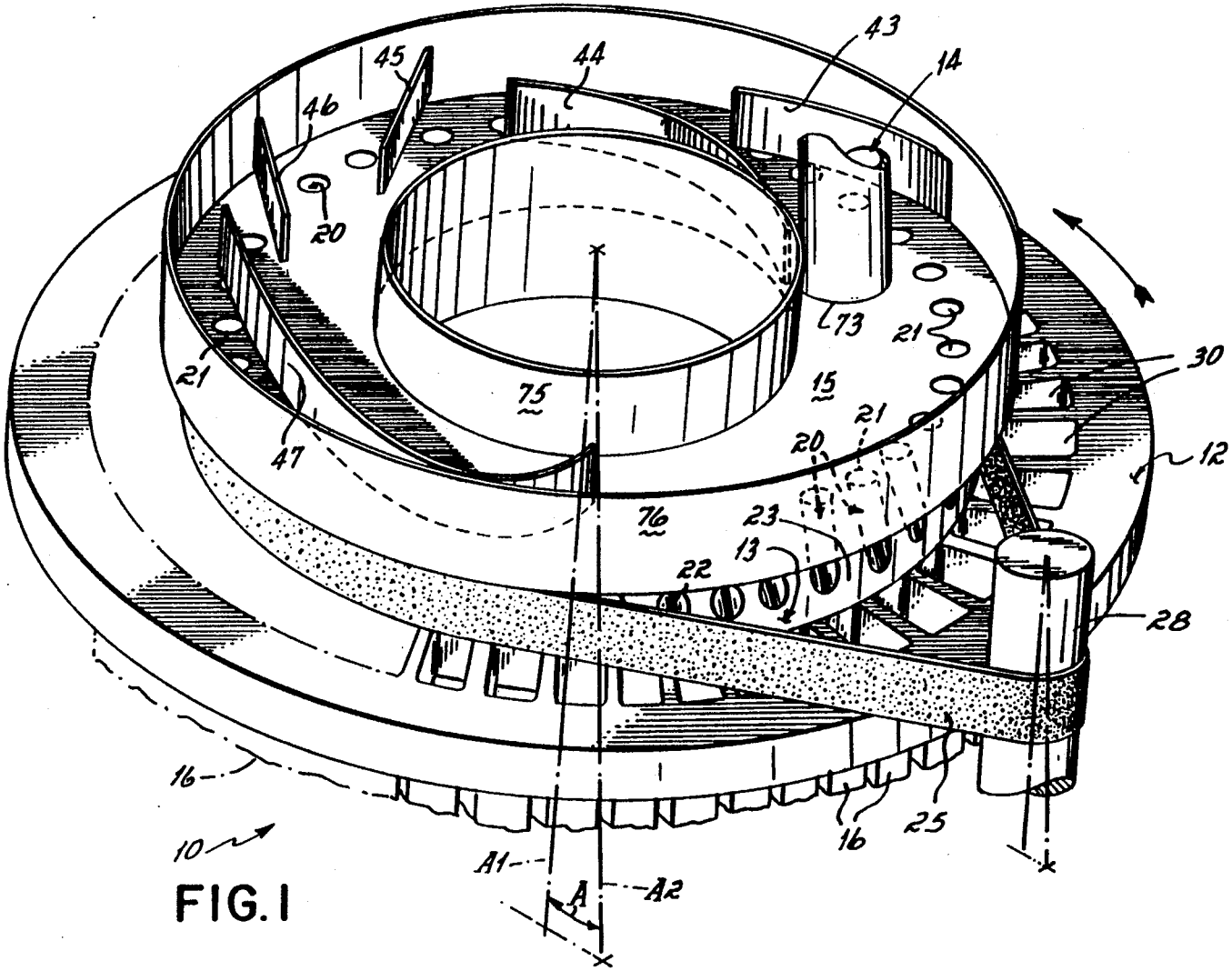
FIG. 1 is a diagrammatic perspective view of a pouch filling apparatus according to the invention.

Turning now to the drawings, FIG. 1 illustrates a volumetric feeder 10 according to the invention. While the invention could be used or easily adapted for use in filling containers or packages of many different types (such as boxes, cartons, cans and other containers) with product, one form of the invention is particularly useful for filling pouches and it is in that context that the description of the preferred embodiment is made. The feeder 10 is preferably utilized in conjunction with a pouch filler wheel 11 (see FIG. 4) for filling pouches entrained about such a filler wheel. The construction of the pouch filler wheel per se does not comprise a part of this invention but is similar to, for example, the pouch filler wheel shown and described in U.S. Pat. No. 3,821,873 which is herewith expressly incorporated herein by reference. Moreover, it will be appreciated that the invention is useful with various product forms and in particular with product in granular form.

Returning to FIG. 1, the volumetric feeder 10 includes, preferably, a spout plate or wheel 12 and a volumetric cavity feeder wheel I 3. A product dispenser 14 (FIG. 7) is disposed above the volumetric cavity feeder wheel 13 for dispensing product onto the top surface 15 of the wheel 13 from where it is swept into metering cavities 20 for discharge into pouches.

Figure 4:
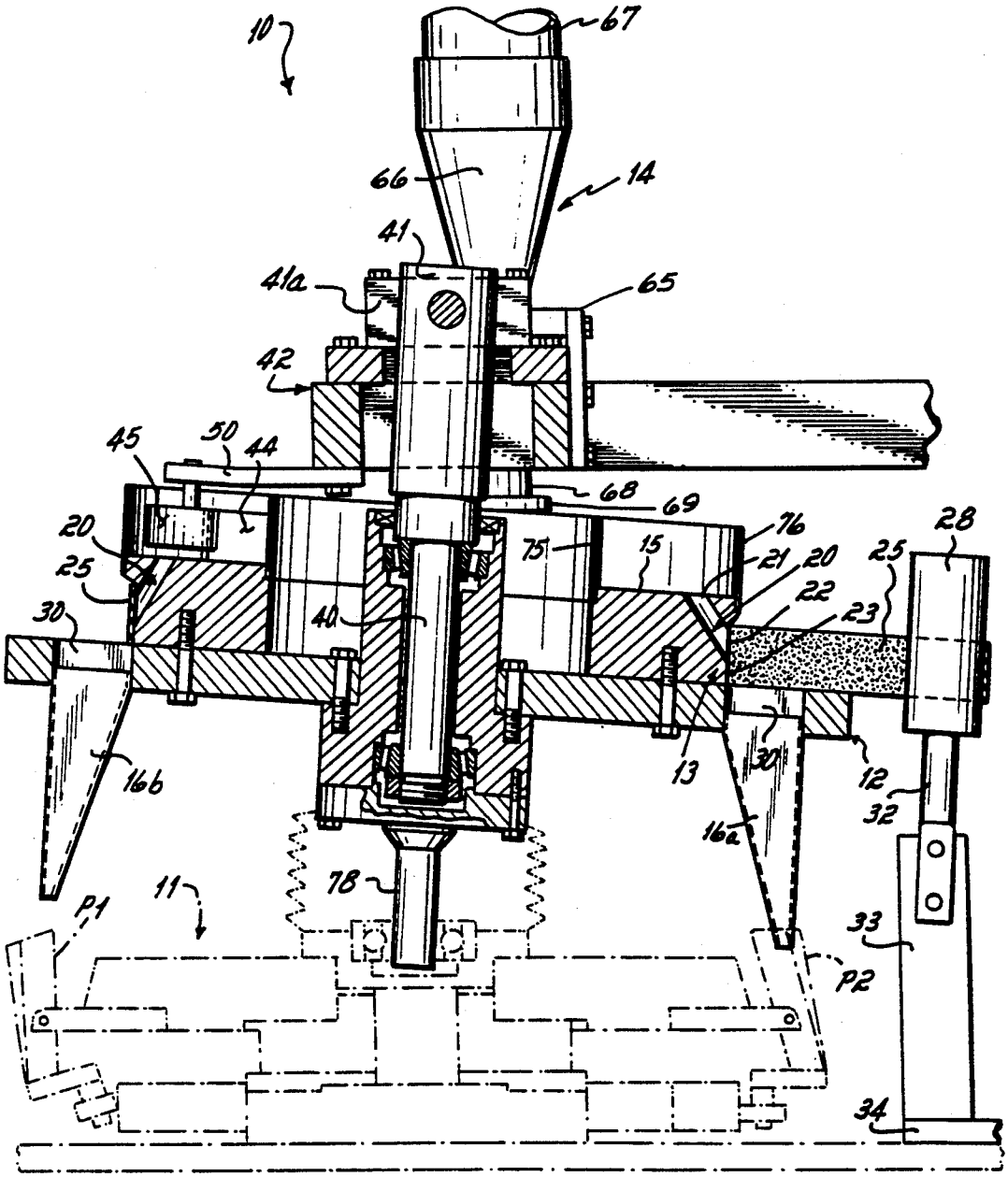
FIG. 4 is a cross-sectional view taken along lines 4—4 of FIG. 3.

Turning now momentarily to FIG. 4, it will be appreciated that the pouch filler wheel 11 is disposed in a pouch line for carrying a plurality of pouches P1, P2, etc., about the filler wheel for filling. As such, the pouches are entrained about the filler wheel 11 in a condition such that the pouches have open tops for receiving filler spouts, such as spout I 6 in this Figure for the deposit of material into the pouches. The formation of the pouch train or the individual pouches and their eventual sealing after they have been filled does not comprise a part of this invention and is well known in the industry. The pouches P1, P2, etc. are filled as they move about the filler wheel at a time when the spouts, such as spout 16*a*, are moved into the open top of the pouches as illustrated in FIG. 4.

The insertion of the spouts I 6 into the pouches is facilitated by the tilting of the plane of the spout plate I 2 with respect to the plane of the pouch filler wheel 11 as clearly illustrated in FIG. 4. Thus, pouches are introduced to the filler wheel I 1 at a position about the periphery of that filler wheel which underlies a raised segment of the spout plate I 2. This is illustrated on the left hand side of FIG. 4. Thereafter, the pouches are moved about the periphery of the filler wheel 11 with the spouts 16 gradually descending into the open mouths of the pouches for filling the pouches. Thereafter, as the motion continues, the spouts 16 are gradually withdrawn from the open mouths of the pouches and the pouches are removed from the filler wheel for further sealing and processing.

Continuing now with reference to FIG. 4 it will be appreciated that the volumetric cavity feeder wheel I 3 includes a plurality of volumetric product measuring cavities 20 disposed about the feeder wheel as illustrated in FIG. 4 and several of the other Figures. The cavities 20 have openings 21 in the upper surface 15 of the feeder wheel 13. Each of the cavities 20 also has an outlet 22 disposed in the outer peripheral edge 23 of the feeder wheel 13. It will be appreciated that these outlets are directed outwardly or in a radial direction with respect to the feeder wheel 13. This feature has the advantage of improving product discharge by taking advantage of the inherent centrifugal force and thus using that force in a useful way.

A belt 25 is entrained about the feeder wheel 13. It will be appreciated that the peripheral edge 23 of the feeder wheel 13 lies in a first path which in this embodiment is circular, corresponding to the outer peripheral edge 23 of the feeder wheel 13. It will also be appreciated that the belt 25 lies in a second path, a large part of which is coextensive with the first path defined by the peripheral edge 23 of the feeder wheel 13. This is perhaps best illustrated in FIG. 2 where a line 26 has been inscribed to illustrate the extent of the coextensive paths defined by the peripheral edge 23 of the wheel 13 and the belt 25. On the other hand, line 27 has been used to illustrate that portion or segment of the first path of the periphery of the peripheral edge 23 which is not coextensive with the belt 25.

Figure 2:
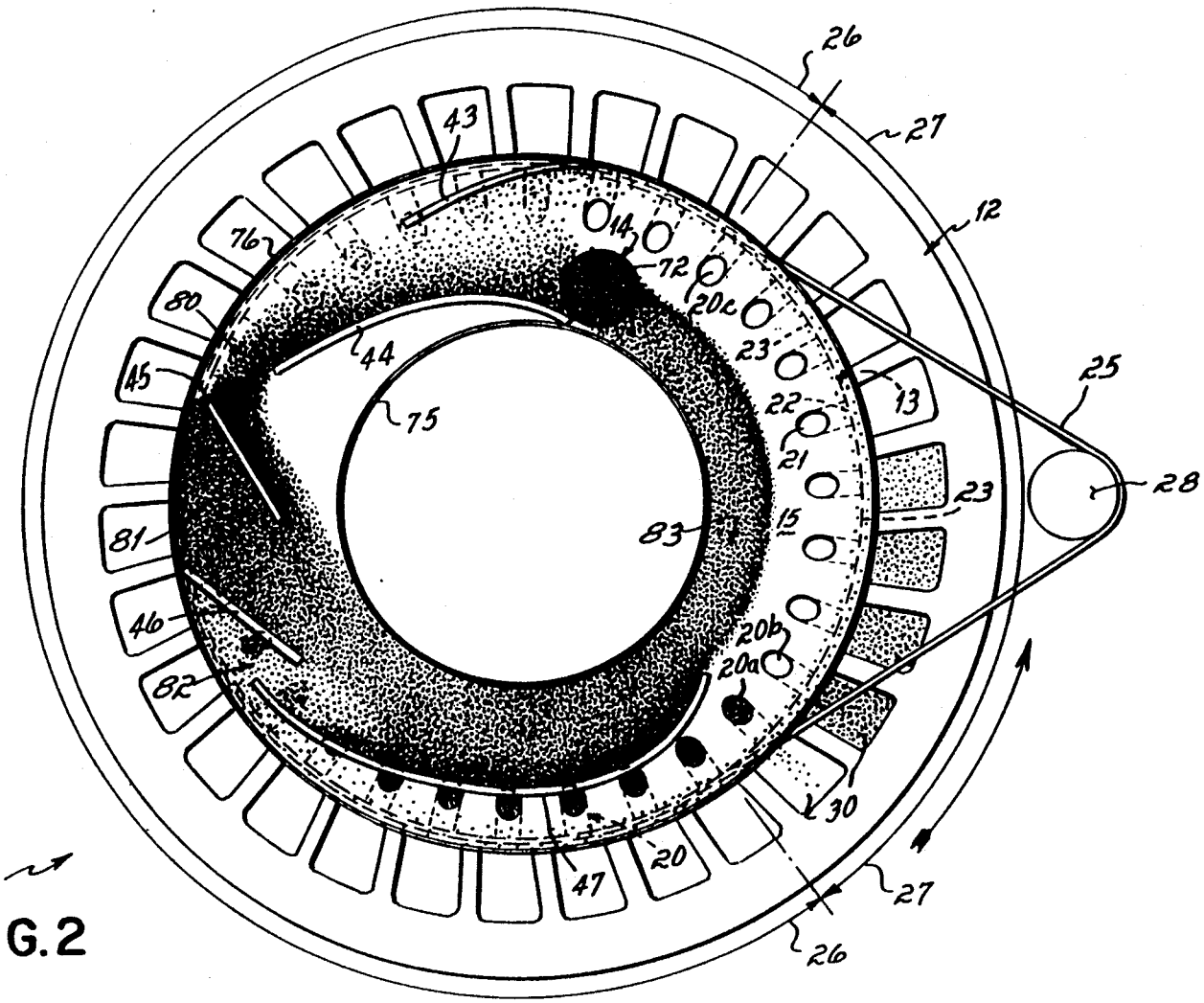
FIG. 2 is a diagrammatic plan view of the invention of FIG. 1, illustrating product metering.
Figure 6:
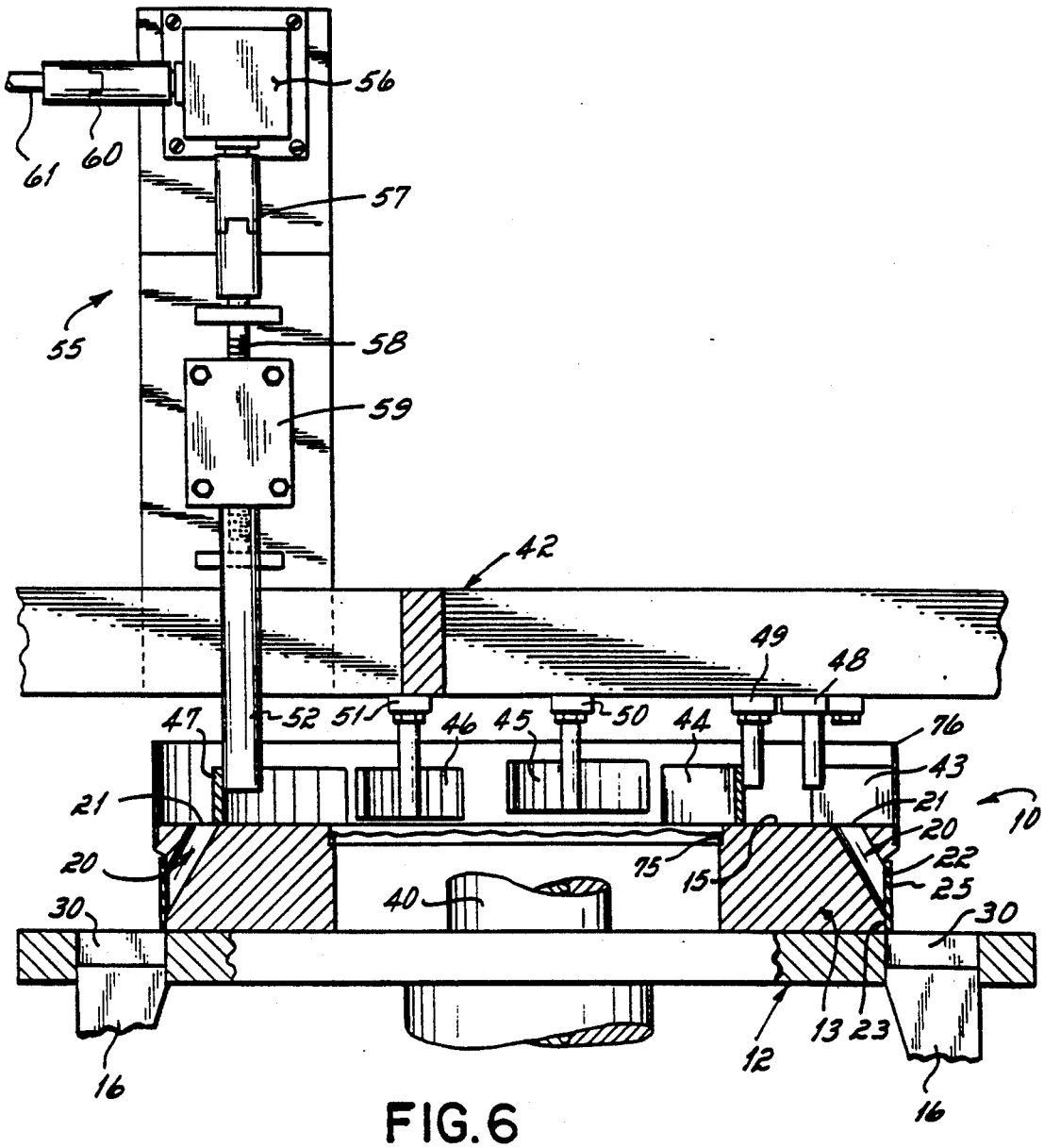
FIG. 6 is a cross-sectional view taken along lines 6—6 of FIG. 3.

It is perhaps best seen in FIGS. 4 and 6, for example, that the belt 25 covers the outlets 22 of the cavities 20 throughout the peripheral edge of the feeder wheel 13 illustrated by the line 26 in FIG. 2. On the other hand, it will be appreciated that the belt 25 is not coextensive with the periphery 23 of the feeder wheel 13 throughout the arcuate segment 27 and thus does not cover the outlets 22 of the cavities 20 moving through that segment or sector, where the path of the peripheral edge 23 is not coextensive with the belt 25. Thus, throughout the motion of the feeder wheel 13 and particularly of its peripheral edge 23 through the arcuate segment 27, the outlets 22 are uncovered and any material in the cavities 20 can flow in a direction which is radially outward of the feeder wheel 13. Material which flows outwardly from the uncovered outlets 22 is directed into product passages 30 in spout plate I 2. These are operatively aligned with the spouts 16 such as spouts 16*a* and 16*b* in FIG. 4.

Figure 3:
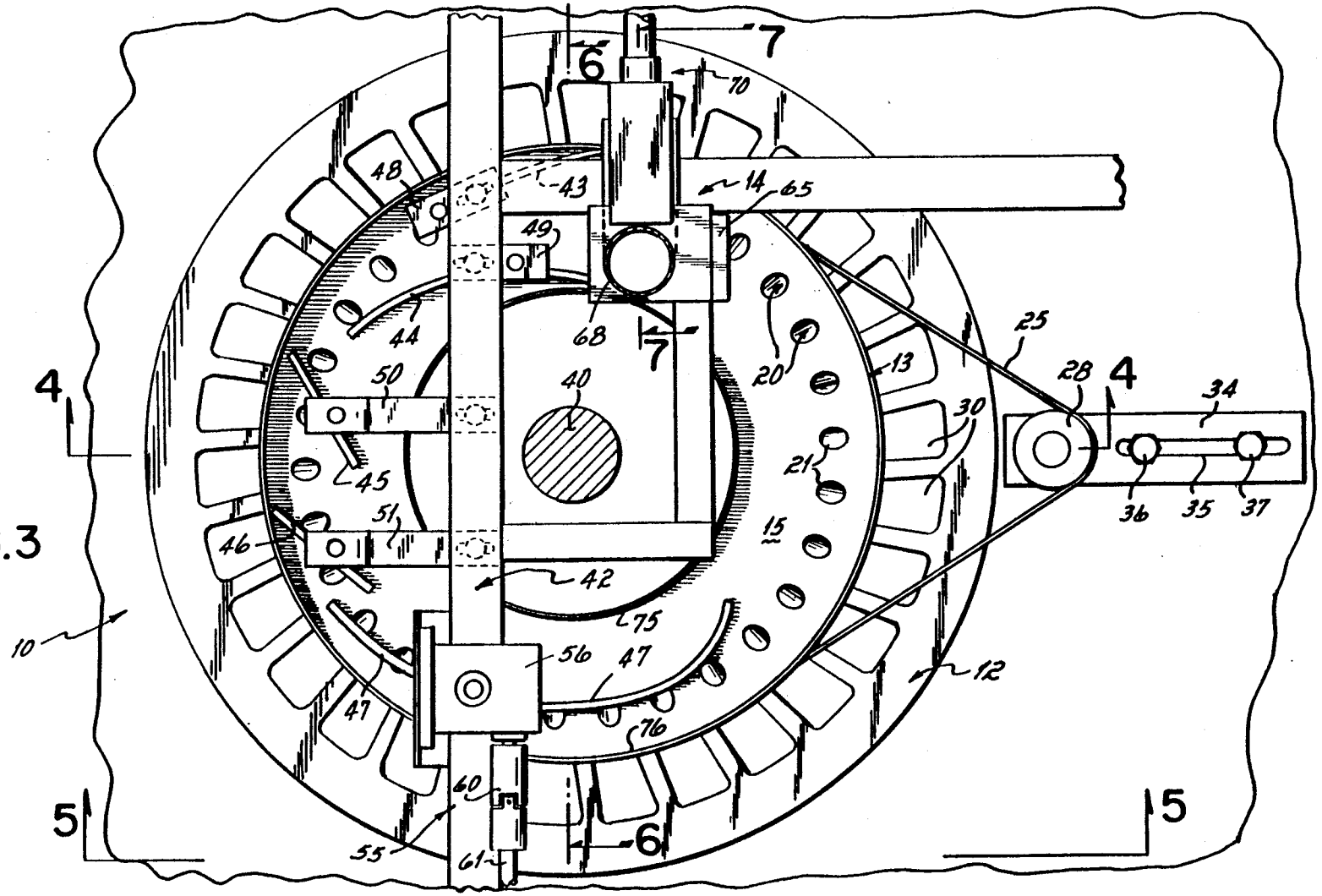
FIG. 3 is a more detailed plan view of the invention of FIG. 1.

It will be appreciated of course that the belt 25 is directed away from the feeder wheel 13 by means of an appropriate idler pulley such as pulley 28. Pulley 28 is mounted on a shaft 32 attached to a bracket 33. Bracket 33 is secured to a lower bracket 34 which, as shown in FIG. 3 is provided with a slot 35 for hold-down bolts 36 and 37. Through loosening of the bolts 36 and 37 the lower bracket 34 can be moved toward or away from the feeder wheel 13 to thereby adjust the tension of the belt 25 as desired.

Preferably belt 25 is made from a urethane material which is easily spliced to the proper length. One form of such a belt is obtained from the Eagle Belting Company or any other suitable supplier.

Referring now to the more detailed features of the embodiment shown in the drawings, it will be appreciated that the feeder wheel 13 and spout plate I 2 are mounted about a central axle member 40 (FIG. 4) having an upper end 41 secured to an appropriate frame member, 41*a*. With reference, however, to FIG. 3, there is provided a frame member 42 on which are mounted a plurality of product plows 43, 44, 45, 46 and 47. Plow 43 is carried on a lateral bracket 48; plow 44 is mounted on a lateral bracket 49; plow 45 is on a lateral bracket 50 and plow 46 is carried on a lateral bracket 51. These brackets 48–51 are adjustable in a vertical direction to vary the disposition of the respective 13 lows with respect to the upper surface 15 of the feeder wheel 13 by means of the respective brackets.

Figure 5:
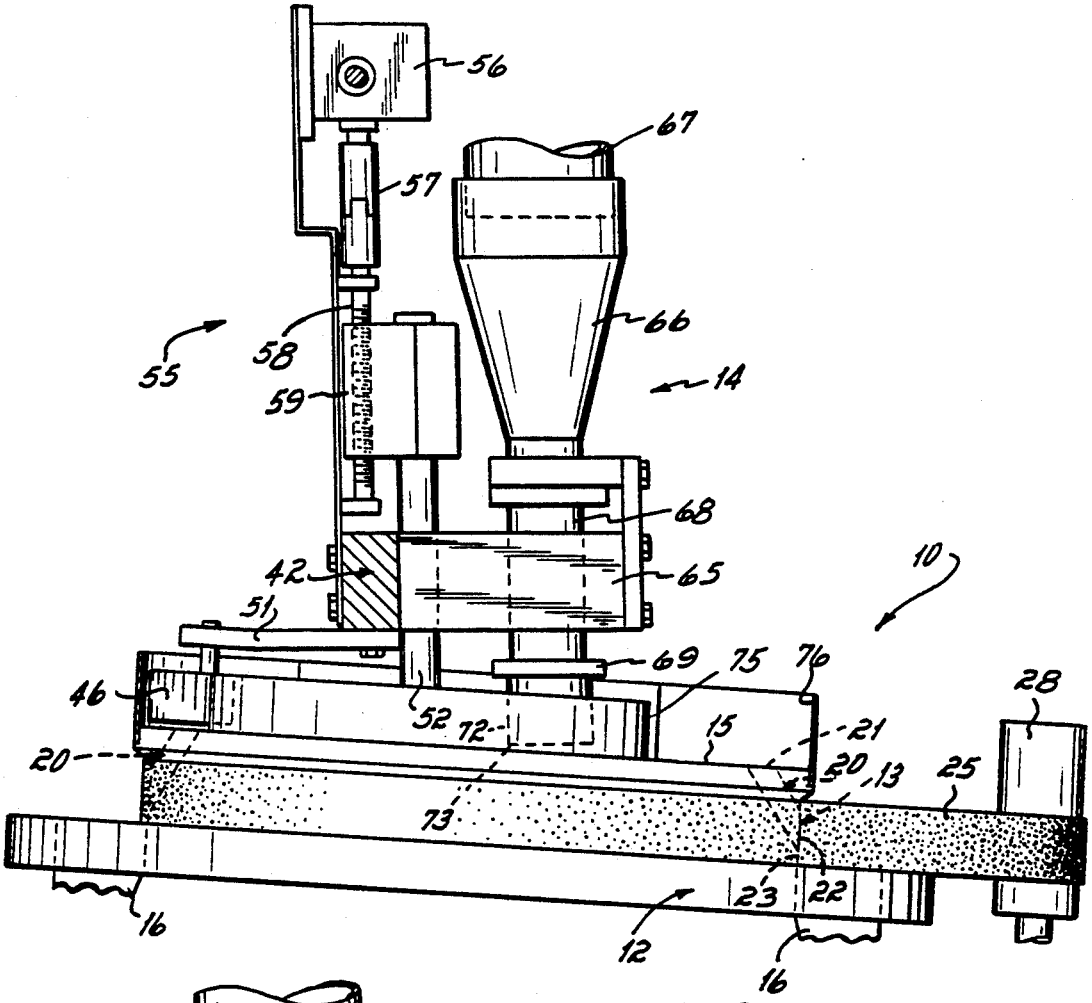
FIG. 5 is an elevational view taken along lines 5—5 of FIG. 3.

On the other hand, the final plow 47 is mounted on the vertical shaft 52 which is adjustable by means of the adjustment apparatus shown in FIG. 5 so that the plow 47 can be adjusted with respect the surface 15. The adjustment apparatus 55 as shown in FIG. 5 comprises a gear box 56 turning a universal joint 57 which is connected to a lead screw 58. A block 59 is attached to the lead screw 58 and the shaft 52 is mounted on the block 59. When the lead screw 58 is turned, the block 59 can translate upwardly or downwardly with respect to the screw to thus raise and lower the plow 47 as directed. The gear box 56 is operated through another universal joint 60 and a shaft 61 externally of the apparatus so that it can be adjusted while the apparatus 10 is in motion.

Figure 7:
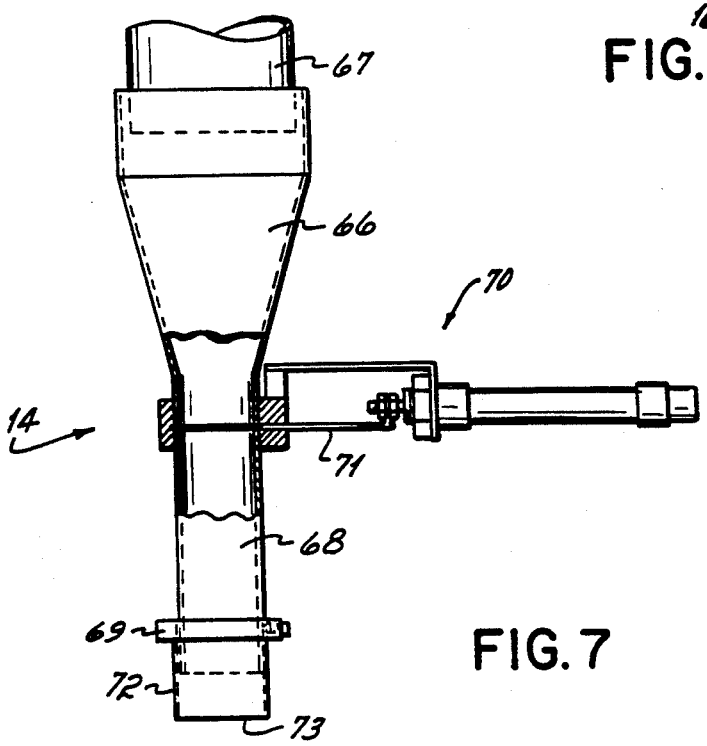
FIG. 7 is a cross-sectional view taken along lines 7—7 of FIG. 3.

It will also be appreciated that the product dispenser 14 is mounted on appropriate framing such as at 65 (FIG. 5) above the surface I 5. The product feed means includes a funnel 66 for receiving from a hopper or supply tube 67 the granular or particulate product which is to be dispensed into the pouches P. Such product may comprise, for example, artificial sweetener, sugar or numerous other particulate or granular products. Product dispenser 14 is provided with a slide cutoff mechanism 70, including gate 71 which can be reciprocated to the left or right as shown in FIG. 7 to cover the outlet from the funnel 66. From the funnel 66, a drop tube 68 depends downwardly and an adjustable collet 69 secures a drop tube 72 onto the tube 68. Collet 69 can be adjusted in a vertical direction to adjust the position of the lower end 73 of the tube 72 with respect to the upper surface I 5 of the feeder wheel 13.

It will also be appreciated that the feeder wheel 13 is provided with an inner fence 75 and an outer fence 76. These define together a circular or annular trough above the top surface 15 of the feeder wheel 13.

It will of course be appreciated that other appropriate framing and support members are provided as shown in various figures of the drawing for the various components as described. It will also be appreciated that the combined feeder wheel 13 and spout plate 12 are connected together and are driven through any appropriate means of the pouch filling equipment such as by means, for example, of the shaft 78 as shown in FIG. 4 which may be attached to the filler wheel 11 which is driven by other appropriate drive and connections. It will thus be appreciated that as the feeder wheel 13 turns, the belt 25 turns with it and is drawn about the pulley 28.

Returning now to FIGS. I and 2, the general operation of the feeder 10 will be appreciated. As the feeder wheel 13 and spout plate 12 rotate in a counter clockwise direction, as viewed from above in FIGS. 1 and 2, particulate material is dropped through the drop tube 72 onto the upper surface I 5 of the feeder wheel 13. The various plows then plow and direct the product over the openings 21 into the cavities 20. This is best illustrated in FIG. 2.

Continued rotation of the feeder wheel I 3 moves the cavities 20 sequentially into the position illustrated by cavity 20*a* in FIG. 2. At this point the belt 25 has begun to pull away from the peripheral edge 23 of the feeder wheel 13 and particulate material is falling outwardly of the outlet 22 in a radial direction into the passage 30 in the spout plate 12. As the cavity 20*a* moves to the position shown at 20*b* in FIG. 2, the belt 25 is now pulled fully away from the outlet 22 and the particulate material feeds into the passage 30, dropping into the associated spout I 6 with the discharge from cavities 20 being assisted by the centrifugal force generated by the turning feeder wheel 13.

With brief reference to FIG. 4, it will be appreciated that at the position of the cavity 20*a* in FIG. 2 a spout 16 has been inserted into a pouch such as illustrated in FIG. 4 by spout 16*a* and pouch P2. It will be appreciated, of course, that the insertion of the lower ends of the spouts I 6 into the pouches is progressive in view of the tilted orientation of the feeder plate 13 and spout plate 12 with respect to the filler wheel I 1. This tilt is illustrated in FIG. 1 as the difference A between the axes A1 and A2.

It should be appreciated that the invention could be produced without the tilt, and that the spouts may be indexed over the open pouch mouths but not inserted within the pouches.

Nevertheless, beginning at cavity 20*a* as shown in FIG. 2, it will be appreciated that preferably the lower end of the spout 16 has been inserted into the open mouth at top end of the pouch for filling. It will also be appreciated that the spouts 16 remain in the pouches throughout the angular sector indicated by the line 27, or that is at least to a point where it can be guaranteed that all particulate material in the cavity 20 has been exhausted into the passages 30 and associated spouts. Once the belt 25 re-engages the peripheral edge 23 such as at the position of the cavity 20*c*, FIG. 2, the spouts can begin to move away from the pouches to a position such as illustrated by spout 16*b* and pouch P1 in FIG. 4, for example. Thus it will be appreciated that the outlets 22 of the cavities 20 are uncovered throughout the arcuate segment 27 so that product therein can be dispensed radially outwardly into the underlying passages 30, spouts 16 and the various aligned pouches. It will also be appreciated that the remaining portion of the top surface I 5 (through arcuator segment 26) can be used for the handling of the product onto the surface 15. That is, throughout the arcuate segment 26, product material can be dropped through the tube 72 onto the top surface 15, and swept over the cavities 20.

The progressive handling of the particulate material on the surface 15 is illustrated in FIG. 2. First, however, reference is made to FIG. 6 where it will be appreciated, as shown, that plows 45, 46 and 47 have been adjusted with varying degrees of gaps between the lower ends of the respective plows and the surface 15. Thus plow 45 is a little bit higher or further away from the surface 15 than plow 46. Plow 46 is slightly further away from the surface 15 than is plow 47. While, as shown in FIG. 6, plow 47 is adjusted to engage the surface I 5, it will be appreciated that plow 47 is preferably either in contact with the surface or is within about one-eighth of an inch of the surface to facilitate the proper handling of the particulate product into the cavities 20. Plows 43 and 44, however, as illustrated in FIG. 6, are preferably disposed on or have their lower edges preferably disposed on the surface 15. These variations are accommodated by means of the various brackets supporting the plows and any suitable interconnection therebetween as will be appreciated.

It will also be appreciated that the lower end 73 of the drop tube 72 from the product dispenser 14 is adjustable vertically with respect to the surface 15 so that the lower end 73 is slightly spaced from the surface. This helps to meter the volume of product dropping onto surface 15 which carries the product away from tube 72. As shown in FIG. 5 it will also be appreciated that the bottom of the end 73 of tube 72 is disposed in a general horizontal plane which is at a slight angle with respect to the tilted surface 15. On the other hand, the brackets 50, 51 supporting the respective plows 45, 46 are bent at their ends such as shown with respect to bracket 51 in FIG. 5, so that the bottom edges of the plows are aligned parallel to the surface 15.

Turning now to FIG. 2, it will be appreciated that product is dispensed from tube 72 onto the surface I 5. The feeder wheel 13 is moving in a counter clockwise direction, as viewed in this Figure, and the product from the tube 72 is swept outwardly toward the outer peripheral edge 23 by means of plow 44. At the same time, plow 43 picks up any product which is left outwardly near the peripheral edge and against the outer fence 76 and sweeps that product inwardly to a point above the openings 21 to the cavities 20. As shown in FIG. 2, the product is thus concentrated in the area 80 where continued motion of the feeder wheel 13 moves the product toward the plow 45. Plow 45 is raised somewhat from the surface 15, but primarily sweeps product from over the ports 21. A quantity of the product 81 on surface I 5 moves under that plow and remains over the openings 21 of the cavities 20, thereby filling them, if they have not already been filled by the product falling through from the area 80.

Thereafter, continued motion of the feeder wheel 13 draws the product toward engagement with the plow 46. This plow is set at still a lower gap and sweeps product from the top of surface 15 in the areas over and proximate to the openings 21 toward the inner periphery of the surface 15. It will be appreciated at this point that some particulate material still resides in the area 82 over the cavities 20 and the openings 21.

The final sweep of product is accomplished by plow 47 which is mounted to engage and gently sweep the surface 15, or is mounted slightly above the surface to finally sweep off or cut off material over the cavities 20. It will be appreciated that plow 47 is disposed in a very gradual curve spanning at least seven or so cavities, thereby gently sweeping product across the top of the surface 15 and over the openings 21. Remaining product is conveyed along in area 83 beneath the dispensing tube 72 and between the plows 43 and 44 for refilling empty cavities there.

It will be appreciated that the progressive cuts across the top of the particulate material on the surface 15 by the plows 45, 46 and 47 manipulate the product throughout a substantial segment of rotation of the surface 15 and thereby gently and progressively remove the product from over the openings 21. This greatly facilities the reduction of turbulence caused by the sweeping motion and contributes to a more accurate, repeatable, fill in each cavity. It will also be appreciated that when the plow 47 is moved slightly upwardly away from the surface 15, some amount of particulate material will reside above the plane of the opening 21, but that material can be very accurately measured by means of the gradual sweep of the plow 47 such that each cavity, when dispensed as it moves the positions at 20*a* and 20*b* in FIG. 2, produces a very accurate volumetric fill of granular product.

Each of the plows, of course, may be made from any suitable material. They may be made from aluminum or metal and have a synthetic material forming the bottom edge of the plow for purposes of wear.

It will also be appreciated that the openings 22 constitute elliptical openings in the peripheral edge 23 of the wheel 13 and that the discharge of the particulate material from the cavities 20 is in a radial direction. This serves to help dispense material quickly from the cavities in view of the centrifugal force on the material as a result of the rotation of the wheel 13.

Accordingly, feeding and dispensing of particulate material into individual pouches is greatly facilitated and the volumetric fills are repeatable with only small inaccuracies. The invention contemplates an expansion of the sector throughout which material on the surface 15 can be handled, thus reducing turbulence and providing more accurate and repeatable fills into cavities 20.

Moreover, the belt 25 greatly facilitates the opening and closing of the outlets 22 and provides a very simple and inexpensive apparatus to facilitate the operation of the feeder 10 as described.

In addition, it will be appreciated that the invention can be modified to provide different metered quantities of product. For example, where it is desired to change the volume of product metered, open-ended sleeves having side walls of tapering thickness may be inserted into the cavities 20 to reduce their volume by that amount necessary to discharge a lesser metered amount than the larger volume without the sleeve. A further way to adjust product metering volume is to provide an additional plate on surface 15 of wheel 13. The plate could have holes, corresponding in volume to the increased volume desired, in register with ports 21. Another way to adjust volume is simply to provide additional, interchangeable wheels 13 having cavities 20 of different volumes.

These and other advantages and modifications will become readily apparent to those of ordinary skill in the art without departing from the scope of this invention and the applicant intends to be bound only by the claims appended hereto.

I claim:

1. A method of feeding volumetrically measured amounts of product into containers comprising the steps of:

dropping product onto the upper surface of a wheel, sweeping the upper surface of the wheel to move product into volumetric cavities open to said surface and to meter the volumetric amount of product in and above said cavities;

turning said wheel and dispensing product in a radial direction from outlets in a peripheral edge of said wheel from said cavities in a selected portion of a path through which said edge moves by entraining a belt about a portion of said edge for covering said outlets, and directing said belt away from said edge in said selected portion to uncover said outlets to dispense product therefrom into containers aligned beneath said cavities.

2. A method of feeding volumetrically measured amounts of product into pouches comprising the steps of:

dropping product onto the upper surface of a wheel, sweeping the upper surface of the wheel to move product into volumetric cavities open to said surface and to meter the volumetric amount of product in and above said cavities;

turning said wheel and dispensing product from outlets in a peripheral edge of said wheel from said cavities in a radial direction and in a selected portion of a path through which said edge moves by entraining a belt about a portion of said edge for covering said outlets, and directing said belt away from said edge to uncover said outlets to dispense product therefrom into pouches aligned beneath said cavities.

3. A method as in claim 2 including filling said cavities when said belt coves said outlets associated therewith.

4. A method as in claim 3 including filling said cavities when said cavities are not aligned with pouches therebeneath.

5. Apparatus for filling open top pouches with measured volumes of product, the apparatus comprising:

a product spout wheel having a plurality of depending spout means for transferring product into open tops of aligned pouches disposed therebeneath, said spout wheel having product receiving spout passages aligned with respective ones of said spout means depending therefrom, a volumetric feeder wheel having an outer peripheral edge movable through a first path, said wheel having volumetric measuring cavities therein, measuring cavity outlets disposed in the peripheral edge of said wheel operatively aligned with respective spout passages, and a belt lying in a second path having a portion substantially coextensive with said first path and a portion which is not coextensive with said first path, said belt covering and sealing said outlets in said coextensive portions of said paths and uncovering said outlets disposed in a portion of said first path which is not coextensive with a portion of said second path for passage of product in a radial direction through said outlets from the peripheral edge of the feeder wheel into said aligned passages, spout means and pouches.

6. Apparatus as in claim 5, wherein said feeder wheel has an upper surface, and openings in said surface communicating with said volumetric measuring cavities, means for dropping product onto said surface and metering plow means for sweeping said upper surface of said feeder wheel to feed product into said cavities through said openings.

7. Apparatus as in claim 6, wherein said feeder wheel and said spout wheel lie in a first plane disposed at an angle to intersect a plane of a pouch filler wheel, such that some of said spout means extend into open tops of said pouches therebeneath, said spout means extending into said pouches being disposed on said spout plate such that they move through a path in register with a portion of said first path which is not coextensive with said second path such that product in said cavities flows through outlets into said spout means and pouches into which said spout means extend only when said spout means are disposed within pouches.

8. Apparatus as in claim 6 wherein said metering plow means comprises a plurality of plows spaced at decreasing distances from said upper surface of said feeder wheel downstream from said product dropping means.

9. Apparatus as in claim 8 wherein a downstream most plow is disposed in a position for sweeping product gradually over a plurality of cavities.

10. Apparatus as i claim 9 further including inner and outer product fences disposed about a respective inner peripheral edge and an outer peripheral edge of said upper surface of said feeder wheel.

11. Apparatus as in claim 5 wherein cavities are filled when said cavity outlets lie in said first path coextensive with said belt path.

12. A volumetric dispensing apparatus comprising:

a rotatable dispensing member having a peripheral edge movable through a first path, product measuring cavities in said member and having feed outlets in said peripheral edge facing radially outward, a belt disposed about said peripheral edge in contact therewith through a portion of said first path, therewith through a portion of said first path, said belt lying in a second path lying one portion coextensive with said first path and another portion not coextensive with said first path, said belt sealing outlets of said cavities along said path where said belt path and said peripheral edge path are coextensive, said outlets so sealed by said belt being opened in that part of said peripheral edge disposed where said first and second paths are not coextensive to selectively uncover said feed outlets for feeding product radially outward from said cavities as said dispensing member rotates.

13. Apparatus for filling containers with measured volumes of product, the apparatus comprising:

a volumetric feeder wheel having an outer peripheral edge movable through a first path, said wheel having volumetric measuring cavities therein, measuring cavity outlets disposed in the peripheral edge of said wheel means for conveying containers beneath said feeder wheel in operative register with said cavity outlets, and a belt lying in a second path having a portion substantially coextensive with said first path and a portion which is not coextensive with said first path, said belt covering and sealing cavity outlets in said coextensive portions of said paths and uncovering said outlets disposed in a portion of said first path which is not coextensive with said second path for passage of product in a radial direction through said outlets from the peripheral edge of the feeder wheel into said containers.

* * * * *

UNITED STATES PATENT AND TRADEMARK OFFICE

CERTIFICATE OF CORRECTION

PATENT NO. : 5,320,146

DATED : June 14, 1994

INVENTOR(S) : John W. Stevie

It is certified that error appears in the above-indentified patent and that said Letters Patent is hereby corrected as shown below: On the title page: Item [54]

In the Title, add the words -- AND METHODS --.

In the Abstract, line 2, "upon" should be -- open --.

Column 2, line 43, "I 3" should be -- 13 --.

Column 2, line 54, "I 6" should be -- 16 --.

Column 2, line 63, "I 6" should be -- 16 --.

Column 2, line 64 and 65, "I 2" should be -- 12 --.

Column 2, line 67, "I 1" should be -- 11 --.

Column 3, line 1, "I 2" should be -- 12 --.

Column 3, line 11, "I 3" should be -- 13 --.

Column 3, line 56, "I 2" should be -- 12 --.

Column 4, line 7, "I 2" should be -- 12 --.

Column 4, line 36, "I 5" should be -- 15 --.

Column 4, line 50, "I 5" should be -- 15 --.

Column 4, line 14, after "is" insert -- mounted --.

Column 4, line 17, "13 lows" should be -- plows --.

Column 5, line 4, "I 5" should be -- 15 --.

Column 5, line 18, "I 6" should be -- 16 --.

UNITED STATES PATENT AND TRADEMARK OFFICE

CERTIFICATE OF CORRECTION

PATENT NO. : 5,320,146

DATED : June 14, 1994

INVENTOR(S) : John W. Stevie

It is certified that error appears in the above-indentified patent and that said Letters Patent is hereby corrected as shown below:

Column 5, line 26, "I 6" should be -- 16 --.

Column 5, line 28, "I 1" should be -- 11 --.

Column 5, line 54, "I 5" should be -- 15 --.

Column 6, line 1, "I 5" should be -- 15 --.

Column 6, line 26, "I 5" should be -- 15 --.

Column 6, line 40, "I 5" should be -- 15 --.

Column 8, line 23, "coves" should be -- covers --.

Column 9, line 14, "i" should be -- in --.

Column 9, line 32 should be deleted.

Column 10, line 1, "lying" should be -- having --.

Signed and Sealed this

Eighth Day of November, 1994

*Attest:*

Bruce Lehman

BRUCE LEHMAN

*Attesting Officer*

*Commissioner of Patents and Trademarks*